US006544362B2

(12) United States Patent
Pike, Jr. et al.

(10) Patent No.: US 6,544,362 B2
(45) Date of Patent: Apr. 8, 2003

(54) TWO STEP AGING TREATMENT FOR NI-CR-MO ALLOYS

(75) Inventors: Lee M. Pike, Jr., Kokomo, IN (US); Dwaine L. Klarstrom, Kokomo, IN (US); Michael F. Rothman, Kokomo, IN (US)

(73) Assignee: Haynes International, Inc., Kokomo, IN (US)

( * ) Notice: Subject to any disclaimer, the term of this patent is extended or adjusted under 35 U.S.C. 154(b) by 3 days.

(21) Appl. No.: 09/894,179

(22) Filed: Jun. 28, 2001

(65) Prior Publication Data

US 2003/0049155 A1 Mar. 13, 2003

(51) Int. Cl.[7] ..... C22F 1/10
(52) U.S. Cl. ..... 148/675
(58) Field of Search ..... 148/675, 428; 420/442

(56) References Cited

U.S. PATENT DOCUMENTS

| | | | | | |
|---|---|---|---|---|---|
| 3,871,928 | A | | 3/1975 | Smith, Jr. et al. | |
| 4,006,012 | A | | 2/1977 | Kindlimann | |
| 4,043,810 | A | | 8/1977 | Acuncius et al. | |
| 4,118,223 | A | | 10/1978 | Acuncius et al. | |
| 4,129,464 | A | | 12/1978 | Matthews et al. | |
| 4,245,698 | A | | 1/1981 | Berkowitz et al. | |
| 4,465,530 | A | * | 8/1984 | Kagohara et al. | 148/410 |
| 4,818,486 | A | | 4/1989 | Rothman et al. | |
| 4,906,437 | A | | 3/1990 | Heubner et al. | |
| 5,019,184 | A | | 5/1991 | Crum et al. | |
| 5,217,684 | A | | 6/1993 | Igarashi et al. | |
| 5,338,379 | A | * | 8/1994 | Kelly | 148/410 |
| 5,360,496 | A | | 11/1994 | Kuhlman et al. | |
| 5,417,918 | A | | 5/1995 | Köhler et al. | |
| 5,556,594 | A | * | 9/1996 | Frank et al. | 420/448 |

FOREIGN PATENT DOCUMENTS

| | | | | |
|---|---|---|---|---|
| JP | 61-0147834 A | | 7/1986 | |
| JP | 03-257131 A | * | 11/1991 | C22C/19/03 |
| JP | 03-0257131 A | | 11/1991 | |
| JP | 07-011403 A | * | 1/1995 | C22C/19/05 |
| JP | 07-011404 A | * | 1/1995 | C22C/19/05 |
| JP | 52-0148416 A | | 12/1997 | |
| WO | WO 00/03053 | | 1/2000 | |

OTHER PUBLICATIONS

"Nickel, Cobalt, and Their Alloys" pub by ASM International, 2000, pp. 31–32.*

"Advanced Microcharacterization of Nickel–Base Superalloys," I. M. Anderson, M. K. Miller, L. M. Pike and D. L. Klarstrom, Oak Ridge National Laboratory, CRADA Final Report, Feb. 2000.

"New Materials and Processing to Enhance Affordability," D. L. Klarstrom, Advanced Technologies for Superalloy Affordability, Symposium sponsored by the Structural Materials Division of The Minerals, Metals & Materials Society (TMS), 2000 TMS Annual Meeting, Nashville, Tennessee, Mar. 12–16, 2000.

"Formation of A $Pt_2Mo$ Type Phase in Long–Term Aged Inconel® Alloy 686," Michael G. Fahrmann and James R. Crum, TMS (The Minerals, Metals & Materials Society), 2000, pp. 813–820.

* cited by examiner

*Primary Examiner*—Roy King
*Assistant Examiner*—Harry D. Wilkins, III
(74) *Attorney, Agent, or Firm*—Buchanan Ingersoll, P.C.

(57) ABSTRACT

A two step heat treatment for Ni—Cr—Mo alloys containing from 12% to 23.5% chromium provides higher yield strength, high tensile strength and other mechanical properties comparable to those observed in similar alloys age-hardened according to current practices. This treatment is done over a total time of not more than 50 hours. However, the treatment works for only those alloys having alloying elements present in amounts according to an equation here disclosed.

5 Claims, 1 Drawing Sheet

$P = 2.64\,Al + 0.19\,Co + 0.83\,Cr - 0.16\,Cu + 0.39\,Fe + 0.59\,Mn + 1.0\,Mo + 0.81\,Zr + 2.15\,Si + 1.06\,V + 0.39\,W + 0.68\,Nb + 0.52\,Hf + 0.45\,Ta + 1.35\,Ti$

Box Limits: $12.0 < Cr < 23.5$ and $31.2 < P < 35.9$

Ni-Cr-Mo Based Alloys - Aged @1300°F/16h/FC to 1100°F/32h/AC $$P = 2.64\,Al + 0.19\,Co + 0.83\,Cr - 0.16\,Cu + 0.39\,Fe + 0.59\,Mn + 1.0\,Mo + 0.81\,Zr + 2.15\,Si + 1.06\,V + 0.39\,W + 0.68\,Nb + 0.52\,Hf + 0.45\,Ta + 1.35\,Ti$$

Box Limits: $12.0 < Cr < 23.5$ and $31.2 < P < 35.9$

TWO STEP AGING TREATMENT FOR NI-CR-MO ALLOYS

FIELD OF THE INVENTION

The invention relates to heat treatment processes for nickel-chromium miolybdenum-alloys having a chromium content of from 12 to 23.5 weight percent.

BACKGROUND OF THE INVENTION

It is well-known that chromium imparts corrosion resistance to nickel base alloys. Therefore, Ni—Cr—Mo alloys and particularly those with chromium content of 15 to 24% have been popular for use in corrosive environments such as encountered in the chemical and petrochemical industries.

Age-hardening is a process used in the metallurgical industry to give an alloy composition higher strength, as measured by its yield strength, tensile strength, and by notched stress rupture tests typically used in the art. Various applications demand a combination of high tensile strength and low thermal expansion properties. One such application is in the aerospace industry. Another application is seal rings used in land-based gas turbines. A combination of high tensile strength and ductility is also very useful for bolts. Because of the demanding operating conditions and performance parameters for metal products in these applications, various methods of age-hardening have been used. One common technique is to heat the alloy to a selected high temperature, hold the alloy at that temperature for a period of time and then cool the alloy to room temperature. For some alloy compositions, the alloy may be heated to one temperature, cooled, heated again to a second temperature and cooled. Examples of these processes are disclosed in U.S. Pat. No. 3,871,928. The temperatures and time periods used to age harden an alloy depend upon the composition of the alloy. For all age-hardenable commercial alloys there are established times and temperatures used that have become standard in the industry because they are known to produce the desired properties. For Ni—Cr—Mo alloys having high chromium content, that is chromium greater than 12%, the general view in the art is that heat treatment beyond the initial annealing in an effort to improve mechanical properties would be impractical due to the lengthy required times (hundreds to thousands of hours) and such treatments simply have not been done.

Solid-solution strengthened nickel-chromium-molybdenum (Ni—Cr—Mo) alloys and nickel-molybdenum (Ni—Mo) alloys are widely utilized for commercial applications in the chemical industry, for example. Generally, considered to be single phase materials, discounting the presence of minor carbide phases, alloys such as these are not usually considered responsive to heat treatment, and are therefore used in the annealed condition. There are exceptions, where some particular alloys do exhibit a commercially exploitable age hardening response. However, in these instances the age-hardening response observed is attributable to other elements, such as niobium, aluminum and titanium being present in the alloy composition. The exception to this is HAYNES® 242™ alloy which will be discussed later. The fact that Ni—Cr—Mo and Ni—Mo alloys are not commercially age-hardenable does not mean that they do not exhibit any metallurgical response to thermal exposure at intermediate temperatures. Actually, alloys of this type can exhibit complex secondary phase reactions when exposed in the temperature range from about 1000° F. to 1600° F. Unfortunately, the phases which form can often be deleterious to both alloy ductility and other aspects of service performance. This is particularly observed with Ni—Mo alloys containing about 25 to 30% molybdenum. In such materials, exposure at temperatures from about 1000° F. to 1600° F. can result in the rapid formation of embrittling $Ni_3Mo$ or $Ni_4Mo$ phases in the microstructure. This can be a problem for both component manufacturing and for component performance.

For lower molybdenum, higher chromium, content Ni—Cr—Mo alloys with about 16% molybdenum and 16% chromium weight percent content, the occurrence of these particular intermetallic phases is not usually observed after short term thermal exposures. With longer term exposure at temperatures from about 1000° F. to 1200° F., there is a distinctly different metallurgical response. After about 500 to 1000 hours the presence of the phase $Ni_2(Mo,Cr)$ is evidenced in the microstructure. A long-range-ordered phase, with structure similar to that of $Pt_2Mo$, the $Ni_2(Mo,Cr)$ phase serves to significantly increase the strength of these materials without a severe loss of ductility. The one major drawback is the prolonged aging time required to produce this phase.

There are several United States patents that disclose Ni—Cr—Mo alloys. U.S. Pat. No. 4,818,486 discloses a low thermal expansion nickel based alloy that contains 5% to 12% chromium and 10% to 30% molybdenum. The patent teaches that the aging times typically required to obtain desired hardness without deleterious phases being formed is well over 1000 hours at temperatures of 1200° F. to 1500° F. for most Ni—Mo—Cr alloys. However, the aging time to harden the alloy composition disclosed in the '486 patent is as little as 24 hours at 1200° F. The alloy of this patent has been marketed under the trademarks 242 alloy and HAYNES 242 alloy. HAYNES 242 alloy has been sold for applications requiring high tensile strength and a low coefficient of thermal expansion. Other beneficial properties of the 242 alloy include good thermal stability, good low cycle fatigue resistance, and excellent containment capabilities due to its tensile strength and ductility. HAYNES 242 alloy consists of about 8% (weight percent) chromium, about 20–30% molybdenum, about 0.35% to up to about 0.5% aluminum, up to 0.03% carbon, up to about 0.8% manganese, up to about 0.8% silicon, up to about 2% iron, up to about 1% cobalt, up to about 0.006% boron, and the balance weight percent being nickel.

There is a need for a shorter commercially exploitable age hardening process for Ni—Mo—Cr alloys with higher Cr levels (>12% Cr) than found in U.S. Pat. No. 4,818,486 that avoids formation of deleterious $Ni_3Mo$ and $Ni_4Mo$ phase, as well as mu-phase occurrence.

Another Ni—Cr—Mo alloy is disclosed in U.S. Pat. No. 5,019,184 to Crum et al. That alloy contains 19% to 23% chromium and 14 to 17% molybdenum. The patent discloses homogenization heat treatment at temperatures ranging from 1149° C. to 1260° C. for periods of from 5 to 50 hours. The purpose of the treatment is to produce a corrosion resistant alloy having a desired microstructure rather than to strengthen the alloy. No tensile strength data is given for any of these samples disclosed in the patent. The alloy of this patent has been commercialized under the designation INCONEL® alloy 686.

Yet another corrosion resistant Ni—Cr—Mo alloy is disclosed in U.S. Pat. No. 4,906,437 to Heubner et al. This alloy contains 22% to 24% chromium and 15% to 16.5% molybdenum. There is no disclosure of any heat treatment or age hardening of this alloy. The alloy disclosed in this patent has been commercialized under the designation VDM NICROFER 923 h Mo or Alloy 59.

A high yield strength Ni—Cr—Mo alloy is disclosed in U.S. Pat. No. 4,129,464 to Matthews et al. This alloy contains 13% to 18% chromium and 13% to 18% molybdenum. The patent says that the alloy could be aged using a single step aging treatment of at least 50 hours at 900° F. to 1100° F., but all examples are aged 168 hours or more. The statement that at least 50 hours is required was an extrapolation of the results obtained from a 168 hours aging treatment. The patent reports data for three alloys numbered 1, 2 and 3. Alloy 1 is commercially available under the trademark HASTELLOY C-276 alloy. Alloy 2 is commercially available as HASTELLOY C-4 alloy. Alloy 3 is commercially available as HASTELLOY S alloy.

SUMMARY OF THE INVENTION

We provide an improved two-step age hardening process for certain nickel-chromium-molybdenum alloys containing from 12% to 23.5% chromium that results in higher yield strength, high tensile strength and comparable other mechanical properties as those observed with the current age-hardening process used in the art, such properties being measured by yield strength, tensile strength, and tensile ductility tests at room temperature. This process works only for those alloys in which the other alloying elements are present in amounts so that the composition has a P value within the range of 31.2 to 35.9 where P is defined by the equation:

$$P=2.46\ Al+0.19\ Co+0.83\ Cr-0.16\ Cu+0.39\ Fe+0.59\ Mn+1.0\ Mo+0.81\ Zr+2.15\ Si+1.06\ V+0.39\ W+0.68\ Nb+0.52\ Hf+0.45\ Ta+1.35\ Ti$$

The improved age-hardening process involves an alloy with this P value that has been given an age hardening treatment at about 1300° F. for about 12 to 20 hours, furnace cooling to about 1100° F. and holding the material at about 1100° F. for about 28 to 36 hours, followed by air cooling to room temperature. A Ni—Cr—Mo alloy having 12% to 23.5% chromium and treated with this two-step heat treatment or age-hardening process shows improved or comparable tensile strength to the standard aging process used in the lower chromium level 242 alloy. Because of the combination of high yield strength and ductility properties, the alloy and two-step aging process significantly increase affordability of this alloy for applications requiring such properties.

Recently we have observed that a two stage heat treatment performed over a total time of from 10 to 20 hours can provide acceptable mechanical properties. However, when a similar two step process was tried for Ni—Cr—Mo alloys with higher chromium content, some alloys had acceptable properties while other alloys did not. A higher chromium content is desirable for alloys intended for use as corrosion-resistant alloys in the chemical process industry. Consequently, we saw a need for determining whether there existed a definable class of high chromium content alloys which would exhibit acceptable mechanical properties when subjected to a relatively short two step aging process.

DESCRIPTION OF THE PREFERRED EMBODIMENTS

Figure 1:
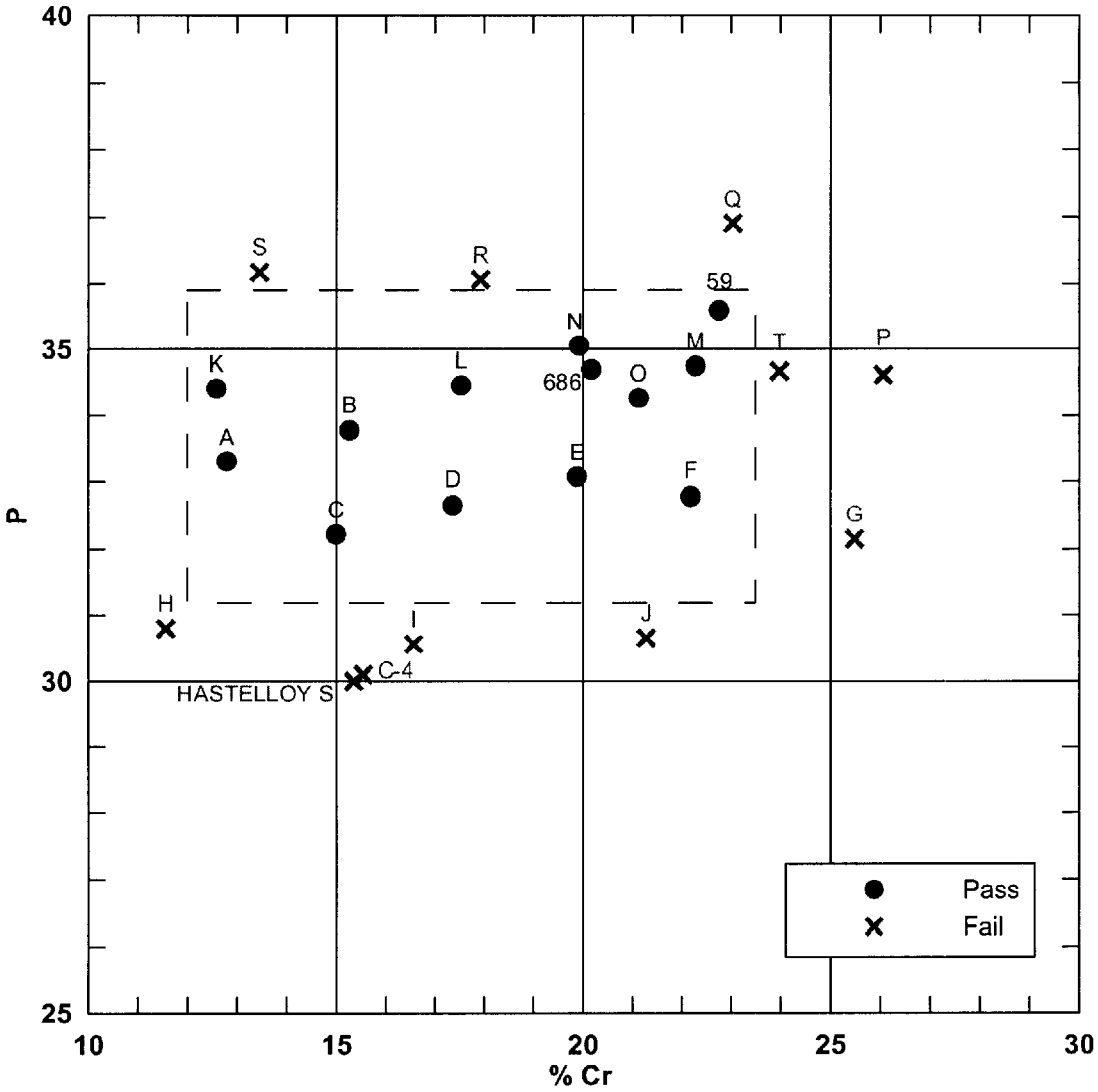
FIG. 1 is a graph of the alloys tested based upon the P value and chromium content of the alloy.

We provide a two-step aging treatment for Ni—Cr—Mo alloys containing from 12% to 23.5% chromium to produce an alloy for applications requiring corrosion resistance, high tensile strength and excellent tensile ductility. This age hardening process involves aging the alloy at about 1275° F. to about 1400° F. for from 8 to 20 hours, cooling the alloy to a temperature of from 1000° F. to about 1125° F., maintaining the alloy within that temperature range for from 24 to 36 hours and cooling the alloy to room temperature. We have found, however, that this process provides acceptable mechanical properties for only those alloys that contain alloying elements in amounts that provides a P value of from 31.2 to 35.9, P being defined as:

$$P=2.46\ Al+0.19\ Co+0.83\ Cr-0.16\ Cu+0.39\ Fe+0.59\ Mn+1.0\ Mo+0.81\ Zr+2.15\ Si+1.06\ V+0.39\ W+0.68\ Nb+0.52\ Hf+0.45\ Ta+1.35\ Ti$$

We tested 20 nickel base test alloys and 5 Ni—Cr—Mo commercial alloys whose compositions are set forth in Table 1. The commercial alloys were HASTELLOY S sheet, HASTELLOY C-276 plate, HASTELLOY C-4 plate, Alloy 59 sheet and INCONEL alloy 686 sheet. The designation "n.m." in Table 1 indicates that the presence of an element was not measured. Table 1 also reports the P value for each alloy.

The chromium content of the test alloys ranged from 11.56% for alloy H to 26.06% for alloy P. Molybdenum ranged from 9.91% in alloy G to 23.89% in alloy S. All of the alloys contained similar amounts of aluminum, cobalt, iron, and manganese. Tungsten was present within a range of 0.11 to 0.34. The alloys also contained small amounts of boron, carbon, cerium, copper, magnesium, phosphorus, sulfur, silicon, and vanadium. The test alloys were annealed after hot rolling to 0.5" plate at annealing temperatures in the range of 1900° F. to 2000° for thirty minutes. The commercial alloys were cut from sheets and plates available from the manufacturer. The sheets were 0.125" and the plates were 0.375" thick. All of the alloys were treated with a two-step aging treatment in which they were first aged at 1300° F. for 16 hours. Then they were furnace cooled to 1100° F. and aged at that temperature for 32 hours. Finally, the samples were air cooled to room temperature.

TABLE 1

Composition Samples Tested

| | Composition | | | | | | | | | |
|---|---|---|---|---|---|---|---|---|---|---|
| Alloy | Al | B | C | Ce | Co | Cr | Cu | Fe | Mg | Mn |
| A | 0.15 | 0.002 | 0.003 | 0.008 | 0.05 | 12.79 | 0.04 | 1.11 | <0.002 | 0.33 |
| B | 0.15 | 0.002 | 0.002 | 0.007 | 0.04 | 15.26 | 0.01 | 1.13 | <0.002 | 0.34 |
| C | 0.12 | 0.003 | 0.006 | 0.008 | 0.05 | 14.99 | 0.03 | 1.05 | <0.002 | 0.32 |

TABLE 1-continued

| Composition Samples Tested | | | | | | | | | | |
|---|---|---|---|---|---|---|---|---|---|---|
| D | 0.12 | 0.005 | 0.002 | <0.005 | 0.08 | 17.36 | 0.03 | 1.08 | 0.003 | 0.32 |
| E | 0.17 | 0.003 | 0.002 | <0.005 | 0.06 | 19.88 | 0.02 | 1.05 | <0.002 | 0.32 |
| F | 0.14 | 0.002 | 0.003 | 0.007 | 0.06 | 22.18 | 0.02 | 1.09 | <0.002 | 0.31 |
| G | 0.13 | 0.005 | 0.002 | 0.005 | 0.07 | 25.48 | 0.02 | 1.12 | 0.003 | 0.32 |
| H | 0.15 | <0.002 | 0.003 | 0.007 | 0.05 | 11.56 | 0.06 | 1.17 | 0.003 | 0.34 |
| I | 0.14 | 0.002 | 0.004 | 0.005 | 0.06 | 16.57 | 0.04 | 1.08 | 0.004 | 0.31 |
| J | 0.14 | 0.002 | 0.005 | 0.004 | 0.06 | 21.28 | 0.04 | 1.07 | <0.002 | 0.31 |
| K | 0.16 | 0.002 | 0.004 | 0.009 | 0.06 | 12.58 | 0.04 | 1.17 | 0.003 | 0.30 |
| L | 0.13 | 0.002 | 0.003 | 0.004 | 0.06 | 17.53 | 0.04 | 1.11 | 0.002 | 0.31 |
| M | 0.17 | 0.002 | 0.006 | 0.005 | 0.06 | 22.28 | 0.01 | 1.17 | 0.002 | 0.30 |
| N | 0.14 | <0.002 | 0.007 | 0.004 | 0.05 | 19.92 | 0.01 | 0.98 | <0.002 | 0.29 |
| O | 0.13 | <0.002 | 0.007 | 0.003 | 0.06 | 21.13 | 0.01 | 1.00 | <0.002 | 0.30 |
| P | 0.13 | <0.002 | 0.006 | 0.003 | 0.07 | 26.06 | <0.01 | 1.02 | <0.002 | 0.29 |
| Q | 0.13 | <0.002 | 0.009 | 0.002 | 0.07 | 23.03 | <0.01 | 1.02 | <0.002 | 0.28 |
| R | 0.13 | <0.002 | 0.007 | 0.005 | 0.06 | 17.92 | 0.01 | 1.04 | 0.002 | 0.27 |
| S | 0.14 | <0.002 | 0.006 | 0.006 | 0.06 | 13.45 | <0.01 | 1.00 | 0.002 | 0.27 |
| T | 0.14 | <0.002 | 0.009 | 0.002 | 0.06 | 23.97 | <0.01 | 0.99 | <0.002 | 0.30 |
| Hastelloy S | 0.22 | 0.008 | 0.010 | n.m | 0.09 | 15.35 | n.m | 1.12 | 0.03 | 0.59 |
| C-276 | 0.30 | n.m | 0.003 | n.m | 0.76 | 15.76 | 0.06 | 5.48 | 0.05 | 0.51 |
| C-4 | 0.34 | n.m | 0.002 | Ti 0.23 | n.m | 15.54 | 0.02 | 1.01 | 0.05 | 0.18 |
| 59 | 0.30 | n.m | 0.002 | n.m | 0.08 | 22.75 | 0.01 | 0.65 | n.m. | 0.17 |
| 686 | n.m. | n.m | 0.005 | Ti 0.07 | n.m | 20.17 | n.m | 0.21 | n.m. | 0.23 |

| | Composition | | | | | | | | |
|---|---|---|---|---|---|---|---|---|---|
| Alloy | Mo | Nb | Ni | P (Phos.) | S | Si | V | W | "P value" |
| A | 21.58 | n.m. | Bal. | <0.004 | 0.001 | <0.01 | 0.01 | 0.19 | 33.3 |
| B | 19.92 | n.m. | Bal. | <0.004 | 0.002 | <0.01 | 0.02 | 0.34 | 33.8 |
| C | 18.78 | n.m. | Bal. | 0.002 | 0.001 | 0.01 | <0.01 | 0.15 | 32.2 |
| D | 17.21 | n.m. | Bal. | 0.003 | 0.001 | 0.02 | <0.01 | 0.14 | 32.7 |
| E | 15.40 | n.m. | Bal. | 0.005 | 0.001 | 0.03 | <0.01 | 0.14 | 33.1 |
| F | 13.32 | n.m. | Bal. | 0.002 | 0.001 | 0.01 | <0.01 | 0.14 | 32.8 |
| G | 9.91 | n.m. | Bal. | 0.002 | 0.001 | 0.02 | <0.01 | 0.18 | 32.2 |
| H | 19.75 | n.m | Bal. | <0.004 | 0.001 | 0.15 | 0.02 | 0.15 | 30.8 |
| I | 15.60 | n.m. | Bal. | <0.002 | 0.003 | 0.07 | 0.02 | 0.15 | 30.6 |
| J | 11.79 | n.m. | Bal. | <0.002 | 0.004 | 0.07 | 0.02 | 0.14 | 30.7 |
| K | 22.48 | n.m. | Bal. | <0.004 | <0.001 | 0.15 | 0.02 | 0.22 | 34.4 |
| L | 18.63 | n.m. | Bal. | <0.004 | 0.003 | 0.11 | 0.02 | 0.15 | 34.5 |
| M | 14.73 | n.m. | Bal. | 0.005 | 0.001 | 0.16 | 0.02 | 0.18 | 34.7 |
| N | 17.38 | 0.03 | Bal. | <0.002 | 0.001 | 0.05 | 0.03 | 0.13 | 35.1 |
| O | 15.62 | 0.03 | Bal. | <0.002 | 0.002 | 0.04 | 0.03 | 0.13 | 34.3 |
| P | 11.82 | 0.03 | Bal. | 0.003 | 0.001 | 0.06 | 0.04 | 0.13 | 34.6 |
| Q | 16.66 | 0.03 | Bal. | 0.003 | 0.001 | 0.05 | 0.03 | 0.13 | 36.9 |
| R | 20.08 | 0.03 | Bal. | 0.005 | 0.001 | 0.04 | 0.03 | 0.14 | 36.1 |
| S | 23.89 | 0.03 | Bal. | 0.002 | 0.001 | 0.04 | 0.03 | 0.15 | 36.2 |
| T | 13.60 | 0.03 | Bal. | 0.003 | 0.001 | 0.06 | 0.04 | 0.11 | 34.7 |
| Hastelloy S | 14.80 | n.m. | Bal. | n.m | 0.005 | 0.48 | | 0.23 | 30.0 |
| C-276 | 15.43 | 0.09 | Bal. | 0.007 | 0.002 | n.m | 0.12 | 3.39 | 33.3 |
| C-4 | 15.41 | n.m. | Bal. | n.m. | n.m. | 0.04 | 0.02 | n.m. | 30.1 |
| 59 | 15.45 | n.m. | Bal. | 0.002 | 0.002 | 0.05 | n.m. | n.m. | 35.6 |
| 686 | 16.08 | n.m. | Bal. | 0.002 | 0.001 | 0.01 | n.m. | 3.94 | 34.7 |

All of the samples were tested to determine their tensile properties. The tests determined yield strength, ultimate tensile strength, and percent elongation by following the standard ASTM E-8 test procedures for such alloys. The results of those tests are reported in Table 2

TABLE 2

| Room Temperature Tensile Properties | | | |
|---|---|---|---|
| Alloy | 0.2% Yield Strength (ksi) | Ultimate Tensile Strength (ksi) | Percent Elongation |
| A | 118.3 | 189.4 | 40.1 |
| B | 119.3 | 188.5 | 40.7 |
| C | 104.8 | 178.3 | 43.4 |
| D | 102.9 | 177.3 | 43.5 |
| E | 100.0 | 173.7 | 44.1 |

TABLE 2-continued

| Room Temperature Tensile Properties | | | |
|---|---|---|---|
| Alloy | 0.2% Yield Strength (ksi) | Ultimate Tensile Strength (ksi) | Percent Elongation |
| F | 73.7 | 139.5 | 47.6 |
| G | 47.0 | 107.1 | 61.8 |
| H | 52.0 | 122.0 | 65.1 |
| I | 49.5 | 116.9 | 64.3 |
| J | 44.1 | 107.8 | 64.1 |
| K | 119.2 | 194.0 | 41.1 |
| L | 95.6 | 169.7 | 47.9 |
| M | 96.1 | 169.1 | 45.8 |
| N | 93.4 | 168.0 | 47.3 |
| O | 91.2 | 166.1 | 47.3 |
| P | 49.8 | 110.4 | 60.7 |

TABLE 2-continued

| Alloy | Room Temperature Tensile Properties 0.2% Yield Strength (ksi) | Ultimate Tensile Strength (ksi) | Percent Elongation |
|---|---|---|---|
| Q | 108.4 | 177.9 | 34.5 |
| R | 117.4 | 189.3 | 32.4 |
| S | 139.5 | 213.6 | 28.0 |
| T | 59.3 | 119.7 | 57.8 |
| HASTELLOY S | 67.5 | 133.1 | 47.1 |
| C-276 | 53.5 | 116.4 | 56.7 |
| C-4 | 72.1 | 137.4 | 47.6 |
| Alloy 59 | 86.2 | 154.6 | 47.3 |
| INCONEL alloy 686 | 98.9 | 169.6 | 45.0 |

Only test alloys A through F and K through O and commercial alloys INCONEL alloy 686 and alloy 59 had acceptable tensile properties. Alloys G, H, I, J, P and T, as well as all the commercial alloys except INCONEL alloy 686 and alloy 59, have unacceptably low yield strengths. The acceptable alloys had elongation values greater than 40 percent and yield strengths greater than 73 ksi. Alloys Q, R and S did not posses enough tensile ductility as measured by the percent elongation. Microstructure analysis confirmed that this was due to the presence of undesirable precipitation of an unidentified phase. Since the chromium content and molybdenum content of the commercial alloys and alloys H, I, J, Q and R are within the range of chromium content and molybdenum content of the acceptable alloys it is clear that neither chromium content nor molybdenum content is the sole predictor of acceptable tensile properties in this class of alloys. We concluded that it is the interaction of nearly all of the alloying elements that is the predictor of such properties. Indeed, we discovered that when the alloy has a P value in the range of 31.2 to 35.9 acceptable tensile properties were achieved with this two-step aging process. An exception to this behavior was found in the HASTELLOY C-276 alloy which has a P value in the desired range, but did not have sufficient yield strength. However, the amount of 5.48% Fe in that alloy is sufficient to best call it a Ni—Cr—Mo—Fe alloy. Therefore, we suggest that a limit of about 3% Fe is needed for the above relationship to hold.

FIG. 1 is a graph of the tested alloys based upon the P value of the alloy and the chromium content. Each alloy that had acceptable tensile properties is plotted with a dot. An X is used to plot those alloys whose tensile properties were not acceptable after the alloy was subjected to the two-step aging treatment. A box has been drawn around the acceptable alloys. It is readily apparent from FIG. 1 that the acceptable alloys have a chromium content of 12% to 23.5% and a P value within the range of 31.2 to 35.9.

Those skilled in the art will recognize that while chromium and molybdenum must be present within the ranges encompassed by the test specimens, other alloying elements are not so limited. Indeed, those elements could be present in amounts within the ranges set forth in the UNS descriptions for commercially available Ni—Cr—Mo alloys which include those tested here and alloys such as C-2000® alloy, C-22® alloy, SM 2060 Mo alloy and MAT-21 alloy. More specifically there could be up to 0.05% aluminum, 0.015% boron, 0.02% carbon, 2.5% cobalt, 2.0% copper, 3.0% iron, 1.5% manganese, 1.25% niobium, 0.04% phosphorus, 0.03% sulfur, 0.75% silicon, 2.2% tantalum, 0.7% titanium, 0.35% vanadium and 4.5% tungsten and 0.1% of a rare earth element.

Having now defined the alloys that can benefit from the two-step age hardening process we considered what time and temperature range for each step would be acceptable. A series of aging treatments was given to Alloy M. After the aging treatments were performed the hardness was measured to determine whether the samples had age hardened. The results are shown in Table 3. A sample was determined to have age hardened if it had a Rockwell C (Rc) hardness value of more than 20.0. A sample in the unaged condition confirmed that the material started out with a hardness of less than 20.0. The test results indicate that the first step should be at least about 8 hours long at a temperature ranging from about 1275° F. to about 1400° F. while the second step should be at least about 24 hours long at a temperature ranging from about 1000° F. to about 1125° F. The data also indicates that when a higher temperature is used for the first step then a lower temperature can be used for the second step. While first step temperatures of up to 1700° F. were found to be useful in age hardening the alloy, microstructural examination revealed that an undesirable grain boundary precipitation occurred when the first step temperature was 1400° F. or greater. This precipitation would be expected to degrade corrosion resistance.

As is well-known in the art, $Ni_2(Mo,Cr)$ age hardening begins with short range ordering followed by creation of precipitates that impart the hardening property. Upon continued heating a solvus temperature will be reached at which the precipitates will go back into solution. The short range ordering is also related to time and temperature. Both the short range ordering and the solvus temperature vary from one alloy composition to another. To provide age hardening any two-step aging treatment must involve a selection of times and temperatures that provides either the necessary short range ordering or the initial precipitation of the hardening phase in the first step and avoids the solvus during the second step. This can be seen in the data for alloy M in Table 3. When the first step was 1300° F. or 1350° F. for 16 hours, sufficient short range ordering did not occur to support a second step of 1000° F., while the solvus was reached at 1150° F. When the first step was 1400° F. for 16 hours, sufficient short range ordering did occur to support a second step of 1000° while the solvus was again reached at 1150° F. For other nickel-chromium-molybdenum alloys we can expect to see similar results although the temperature combinations may be different. Yet, for alloys containing chromium content of 12% to 23.5% and a P value within the range of 31.2 to 35.9, an acceptable age hardening response can be obtained when first step is at least about 8 hours long at a temperature ranging from about 1275° F. to about 1400° F. and the second step is at least about 24 hours long at a temperature ranging from about 1000° F. to about 1125° F.

TABLE 3

The Effect of Different Aging Treatments on the Hardness of Alloy M

| 1st Step Temp (° F.) | 1st Step Time (h) | 2nd Step Temp (° F.) | 2nd Step Time (h) | Hardness (Rc) |
|---|---|---|---|---|
| Unaged | — | — | — | <20.0 |
| 1200 | 16 | 1000 | 32 | <20.0 |
| 1200 | 16 | 1050 | 32 | <20.0 |
| 1200 | 16 | 1100 | 32 | <20.0 |
| 1200 | 16 | 1150 | 32 | <20.0 |
| 1200 | 16 | 1200 | 32 | <20.0 |
| 1250 | 16 | 1000 | 32 | <20.0 |
| 1250 | 16 | 1050 | 32 | <20.0 |
| 1250 | 16 | 1100 | 32 | <20.0 |

TABLE 3-continued

The Effect of Different Aging Treatments on the Hardness of Alloy M

| 1st Step Temp (° F.) | 1st Step Time (h) | 2nd Step Temp (° F.) | 2nd Step Time (h) | Hardness (Rc) |
|---|---|---|---|---|
| 1250 | 16 | 1150 | 32 | <20.0 |
| 1250 | 16 | 1200 | 32 | <20.0 |
| 1300 | 16 | 1000 | 32 | <20.0 |
| 1300 | 16 | 1050 | 32 | 20.7 |
| 1300 | 16 | 1100 | 32 | 28.6 |
| 1300 | 16 | 1150 | 32 | <20.0 |
| 1300 | 16 | 1200 | 32 | <20.0 |
| 1350 | 16 | 1000 | 32 | <20.0 |
| 1350 | 16 | 1050 | 32 | 27.4 |
| 1350 | 16 | 1100 | 32 | 31.2 |
| 1350 | 16 | 1150 | 32 | <20.0 |
| 1350 | 16 | 1200 | 32 | <20.0 |
| 1400 | 16 | 1000 | 32 | 24.9 |
| 1400 | 16 | 1050 | 32 | 26.6 |
| 1400 | 16 | 1100 | 32 | 28.4 |
| 1400 | 16 | 1150 | 32 | <20.0 |
| 1400 | 16 | 1200 | 32 | <20.0 |
| 1500 | 16 | 1100 | 32 | 31.0 |
| 1600 | 16 | 1100 | 32 | 30.4 |
| 1700 | 16 | 1100 | 32 | 27.8 |
| 1300 | 4 | 1100 | 4 | <20.0 |
| 1300 | 4 | 1100 | 8 | <20.0 |
| 1300 | 4 | 1100 | 16 | <20.0 |
| 1300 | 4 | 1100 | 44 | <20.0 |
| 1300 | 8 | 1100 | 4 | <20.0 |
| 1300 | 8 | 1100 | 8 | <20.0 |
| 1300 | 8 | 1100 | 16 | <20.0 |
| 1300 | 8 | 1100 | 32 | 20.1 |
| 1300 | 8 | 1100 | 40 | 29.4 |
| 1300 | 16 | 1100 | 4 | <20.0 |
| 1300 | 16 | 1100 | 8 | <20.0 |
| 1300 | 16 | 1100 | 16 | <20.0 |
| 1300 | 16 | 1100 | 24 | 20.4 |
| 1300 | 16 | 1100 | 32 | 28.6 |

This process represents a significant advancement. Prior to the present invention Ni—Cr—Mo alloys having greater that 12% chromium were not produced in the age hardened condition since the required aging times were considered to be too great. Because of the energy costs associated with such long treatments the estimated cost of a higher chromium, age-hardened alloy was considered too high and no such alloys are in commercial existence. The two-step age-hardening treatment here disclosed can be done in a total time of less than 100 hours and preferably less than 50 hours. Indeed we prefer to complete the process in from 40 to 48 hours. By using heat treatments totaling less than 100 hours, and preferably not greater than 50 hours, one can produce lower cost, high chromium, Ni—Cr—Mo alloys that have desirable tensile properties. While the process here disclosed may also work when total aging times exceed 100 hours, the energy costs associated with such treatments make the process less desirable and commercially impractical.

Although we have described certain present preferred embodiments of our alloy and method of producing that alloy, it should be distinctly understood that our invention is not limited thereto but may be variously embodied within the scope of the following claims.

We claim:

1. A method for treating an alloy having a composition comprised in weight percent of from 12% to 23.5% chromium, from 13% to 23% molybdenum, up to about 0.5% aluminum, up to 0.02% carbon, up to about 1.5% manganese, up to about 3% iron, up to about 2.5% cobalt, up to about 4.5% tungsten, up to about 0.015% boron, up to about 1.25% niobium; up to about 0.75% silicon; up to about 2.2% tantalum; up to about 0.7% titanium and the balance nickel plus impurities, wherein the alloy has a P value of from 31.2 to 35.9, P being defined as:

$$P=246\ Al+0.19\ Co+0.83\ Cr-0.16\ Cu+0.39\ Fe+0.59\ Mn+1.0\ Mo+0.81\ Zr+2.15\ Si+1.06\ V+0.39\ W+068\ Nb+0.52\ Hf+0.45\ Ta+1.35\ Ti$$

the method comprised of:

age hardening the alloy at about 1275° F. to about 1400° F. for at least 8 hours;

cooling the alloy to a temperature of from 1000° F. to about 1125° F.; maintaining the alloy within that temperature range for at least 24 hours without working the alloy between any of these steps; and cooling the alloy to room temperature.

2. The method of claim 1 wherein the two step heat treatment is completed in not more than 50 hours.

3. The method of claim 1 wherein the alloy is aged at about 1300° F. to 1400° F. for 16 hours, cooled to a temperature of about 1100° F., maintained at that temperature for 32 hours, and cooled to room temperature.

4. The method of claim 1 wherein the alloy is furnace cooled to a temperature of from 1000° F. to about 1125° F.

5. The method of claim 1 wherein cooling the alloy to a temperature of from 1000° F. to 1125° F. is accomplished by cooling the alloy to room temperature and then heating the alloy to the temperature of from 1000° F. to 1125° F.

* * * * *

UNITED STATES PATENT AND TRADEMARK OFFICE

CERTIFICATE OF CORRECTION

PATENT NO. : 6,544,362 B2 
DATED : April 8, 2003
INVENTOR(S) : Lee M. Pike, Jr., Swaine L. Klarstorm and Michael F. Rothman It is certified that error appears in the above-identified patent and that said Letters Patent is hereby corrected as shown below:

Column 3,
Line 31, in the first term of the equation, change "2.46" to -- 2.64 --.

Column 4,
Line 27, in the first term of the equation, change "2.46" to -- 2.64 --.

Column 8,
Line 24, in the first term of the equation, change "2.46" to -- 2.64 --.

Signed and Sealed this

Fourteenth Day of October, 2003

JAMES E. ROGAN
*Director of the United States Patent and Trademark Office*